US010682868B2

(12) United States Patent
Shiki et al.

(10) Patent No.: US 10,682,868 B2
(45) Date of Patent: Jun. 16, 2020

(54) HEATING DEVICE AND INKJET RECORDING DEVICE

(71) Applicant: KONICA MINOLTA, INC., Chiyoda-ku, Tokyo (JP)

(72) Inventors: Takanobu Shiki, Sagamihara (JP); Masashi Sugano, Hachioji (JP); Takashi Nara, Kawagoe (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/267,279

(22) Filed: Feb. 4, 2019

(65) Prior Publication Data

US 2019/0240995 A1 Aug. 8, 2019

(30) Foreign Application Priority Data

Feb. 6, 2018 (JP) ..... 2018-018800

(51) Int. Cl.

| | |
|---|---|
| ***B41J 11/00*** | (2006.01) |
| ***B41J 13/00*** | (2006.01) |
| ***B41J 2/01*** | (2006.01) |
| *B41J 2/045* | (2006.01) |

(52) U.S. Cl.

CPC ..... *B41J 11/002* (2013.01); *B41J 2/01* (2013.01); *B41J 11/007* (2013.01); *B41J 11/0015* (2013.01); *B41J 13/0009* (2013.01); *B41J 2/04573* (2013.01)

(58) Field of Classification Search

CPC .... B41J 2/04573; B41J 2/0458; B41J 11/002; B41J 11/007; B41J 13/0009; B41J 2/01; B41J 11/0015

See application file for complete search history.

(56) References Cited

U.S. PATENT DOCUMENTS 8,240,839 B2 * 8/2012 Yamanobe ..... B41J 2/0057 347/101

FOREIGN PATENT DOCUMENTS

JP 2013097238 A 5/2013

* cited by examiner

*Primary Examiner* — Thinh H Nguyen
(74) *Attorney, Agent, or Firm* — Holtz, Holtz & Volek PC

(57) ABSTRACT

A heating device includes rollers, a heating belt, a heater and a hardware processor. The heating belt is in partial contact with an image generation face of a recording medium and extends over the rollers and circulating in cooperation with the rollers. The heater heats the heating belt. The hardware processor modifies an area of contact between the recording medium and the heating belt. At least two rollers are disposed along a traveling direction of the heating belt and are urged to the recording medium with intermediation of the heating belt. The hardware processor modifies the area of the contact by modifying a distance between a first roller and a second roller among the at least two rollers, the first and second rollers being respectively disposed most upstream and most downstream in the travelling direction of the heating belt.

9 Claims, 7 Drawing Sheets

FIG. 4

T1

| T11 TYPE | T12 BELT PRESSURE LEVEL | T13 PRESET GAP | T14 ALLOWABLE RANGE |
|---|---|---|---|
| PLAIN PAPER | 1 | 0.0mm | 0.0mm-1.0mm |
| BOARD PAPER | 2 | 0.5mm | 0.0mm-1.5mm |
| CORRUGATED BOARD A | 3 | 1.0mm | 0.0mm-2.0mm |
| CORRUGATED BOARD B | 4 | 1.5mm | 0.5mm-2.5mm |
| CORRUGATED BOARD C | 5 | 5.0mm | 4.0mm-6.0mm |
| ⋮ | ⋮ | ⋮ | ⋮ |

FIG.5

T2

| T21 TYPE | T22 AMBIENT TEMPERATURE | T23 INITIAL TEMPERATURE | T24 HEAT LEVEL |
|---|---|---|---|
| CORRUGATED BOARD | 20°C ≤ TEMP. | 30°C ≤ TEMP. | 4 |
| | | 20°C ≤ TEMP. < 30°C | 5 |
| | | 10°C ≤ TEMP. < 20°C | 6 |
| | | TEMP. < 10°C | 7 |
| | TEMP. < 20°C | 30°C ≤ TEMP. | 5 |
| | | 20°C ≤ TEMP. < 30°C | 6 |
| | | 10°C ≤ TEMP. < 20°C | 7 |
| | | TEMP. < 10°C | 8 |
| BOARD PAPER | 20°C ≤ TEMP. | 30°C ≤ TEMP. | 1 |
| | | 20°C ≤ TEMP. < 30°C | 2 |
| | | 10°C ≤ TEMP. < 20°C | 3 |
| | | TEMP. < 10°C | 4 |
| | TEMP. < 20°C | 30°C ≤ TEMP. | 2 |
| | | 20°C ≤ TEMP. < 30°C | 3 |
| | | 10°C ≤ TEMP. < 20°C | 4 |
| | | TEMP. < 10°C | 5 |
| ⋮ | ⋮ | ⋮ | ⋮ |

FIG.6

T3

| T31 HEAT LEVEL | MODE OF HEATING BELT | T32 INITIAL TARGET TEMPERATURE |
|---|---|---|
| 1 | SECOND MODE (LOW TEMPERATURE MODE) | 40 |
| 2 | | 50 |
| 3 | | 60 |
| 4 | | 70 |
| 5 | FIRST MODE (HIGH TEMPERATURE MODE) | 40 |
| 6 | | 50 |
| 7 | | 60 |
| 8 | | 70 |

HEATING DEVICE AND INKJET RECORDING DEVICE

BACKGROUND

1. Technological Field

The present invention relates to a heating device and an inkjet recording device.

2. Description of the Related Art

Inkjet recording devices are known that include recording heads and nozzles on the recording heads. The recording heads supply inks to the nozzles. The nozzles discharge ink droplets onto recording media and generate images.

Such inkjet recording devices heat the recording media to predetermined temperature before discharge of ink droplets in order to control the diffusion of inks on the recording media.

A mechanism for heating of the recording medium is disclosed in, for example, Japanese Patent Application Publication No. 2013-97238. This mechanism includes a belt, a heater disposed inside the belt, and a pressure member. The recording medium passes through a nip between the roller of the belt and the roller of the pressure member and is heated thereby.

However, this mechanism only allows the recording medium to pass through the nip between the two rollers. The recording medium is thereby in instant contact with the heating roller. Thus, the heat is not efficiently conducted to the recording medium. In order to heat the recording medium to a predetermined temperature, the heating roller should be heated above the predetermined temperature. Since the heating roller have poor heat response, the roller reaches the predetermined temperature after a long time.

In the mechanism, a recording medium, such as corrugated board, has internal voids and thus is not efficiently heated to the predetermined temperature even at an increased nip pressure at the nip. The increased nip pressure may crush the recording medium.

If the recording medium is slowly transferred so as to be in sufficient contact with the heating roller for a required time, the productivity is lowered.

SUMMARY

An object of the present invention, which has been made in view of the above mentioned problem, is to provide a heating device that can efficiently heat a recording medium to a predetermined temperature regardless of the type of the recording medium and an inkjet recording device including such a heating device.

To achieve at least one of the abovementioned objects, according to an aspect of the present invention, a heating device includes:

a first group of rollers;

a heating belt in partial contact with an image generation face of a recording medium, the heating belt extending over the first group and circulating in cooperation with the first group;

a heater that heats the heating belt; and a hardware processor that modifies an area of contact between the recording medium and the heating belt, wherein at least two rollers in the first group are disposed along a traveling direction of the heating belt and are urged to the recording medium with intermediation of the heating belt, and the hardware processor modifies the area of the contact by modifying a distance between a first roller and a second roller among the at least two rollers, the first and second rollers being respectively disposed most upstream and most downstream in the travelling direction of the heating belt.

According to a second aspect of the present invention, an inkjet recording device includes:

the heating device; and an image generator that discharges ink droplets onto the recording medium heated by the heating device to generate an image.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 4 illustrates an exemplary pressure setting table.

FIG. 5 illustrates an exemplary heat-level setting table.

FIG. 6 illustrates an exemplary mode table for setting the mode of the heating belt.

DETAILED DESCRIPTION OF EMBODIMENTS

Hereinafter, one or more embodiments of the present invention will be described with reference to the drawings. However, the scope of the invention is not limited to the disclosed embodiments.

Configuration of Inkjet Recording Device

A configuration of an inkjet recording device 1 according to the present embodiment will now be described.

Figure 1:
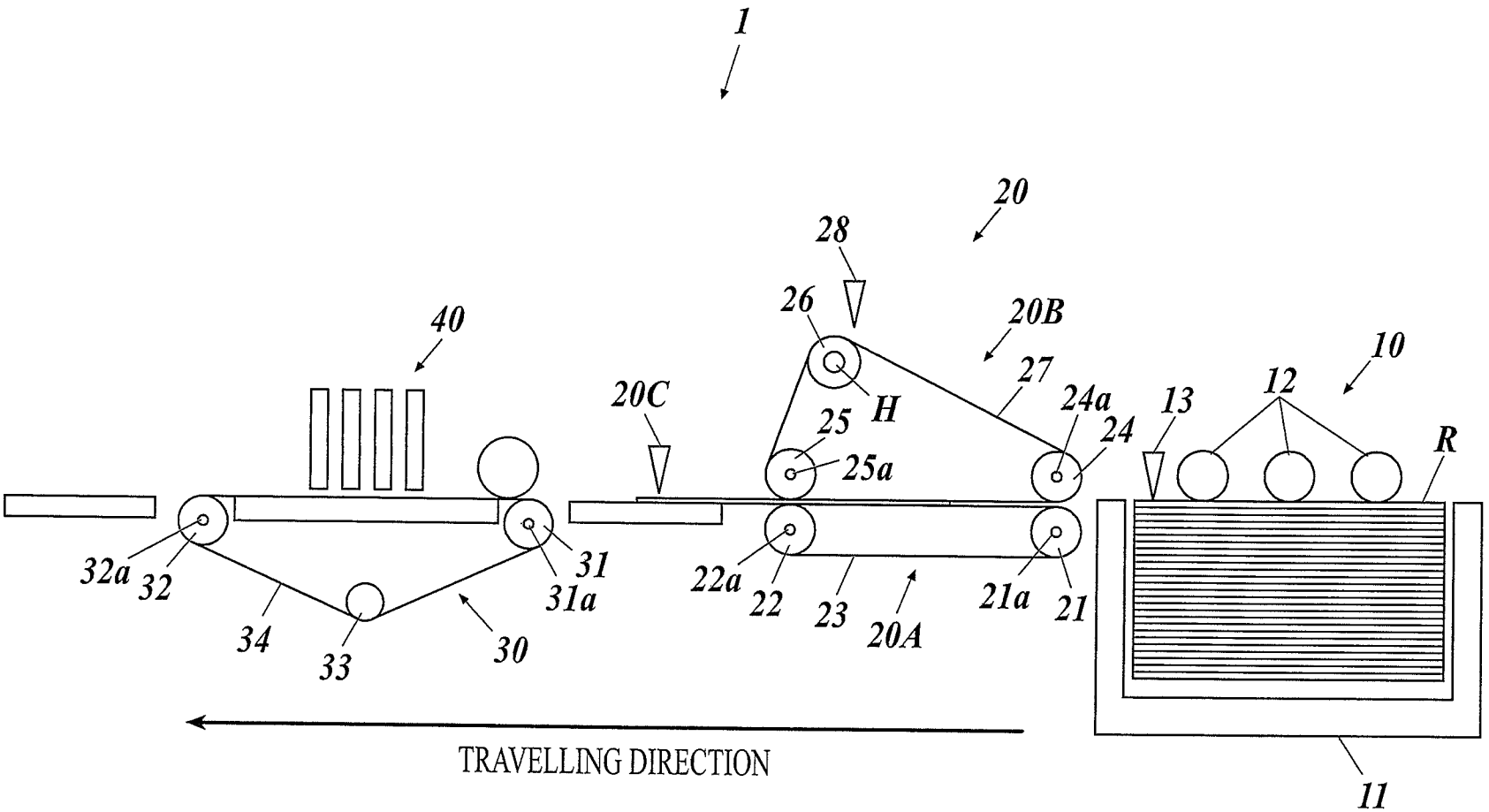
FIG. 1 illustrates a schematic configuration of an inkjet recording device.

FIG. 1 illustrates a schematic configuration of the inkjet recording device 1.

Figure 2:
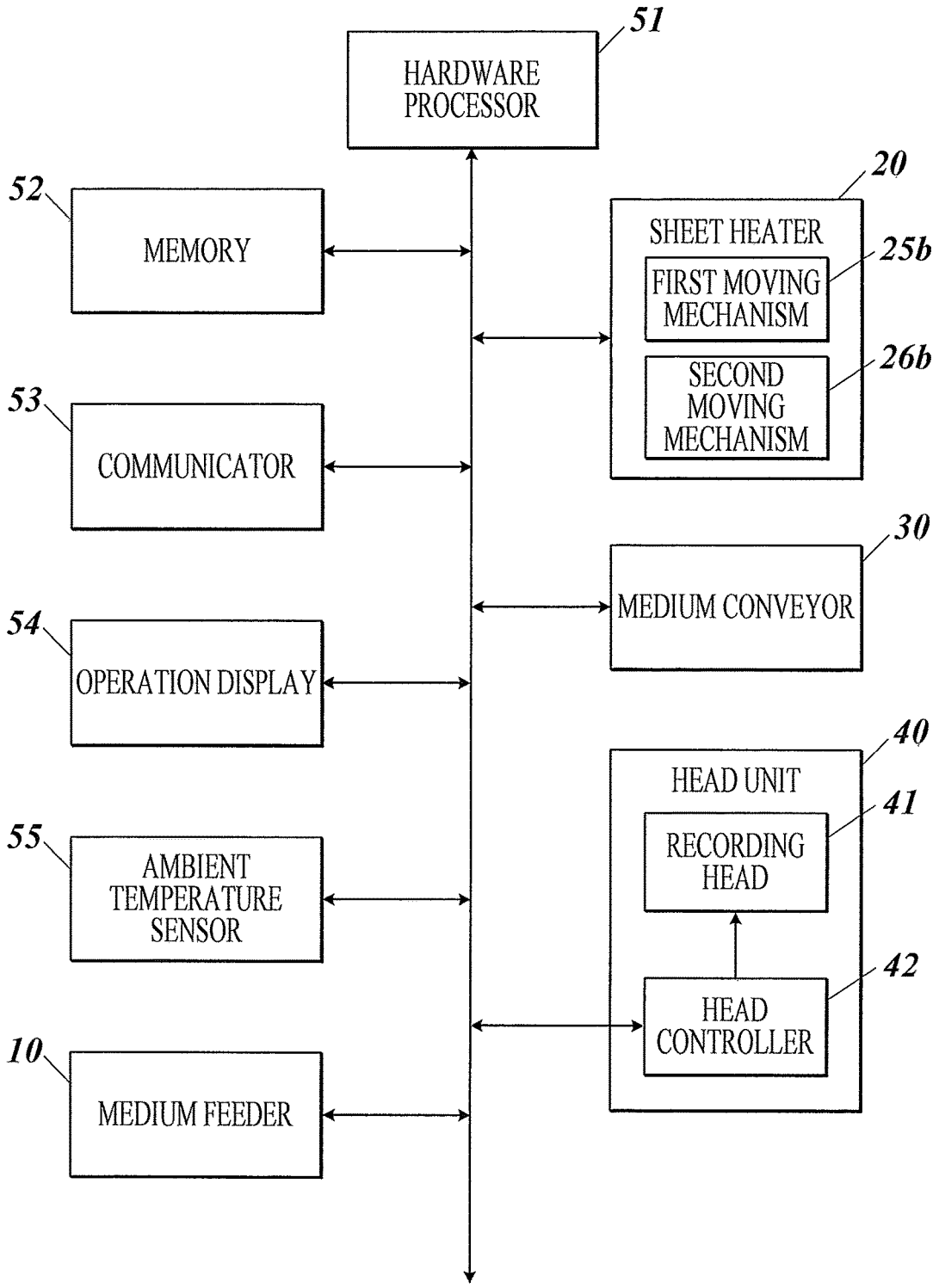
FIG. 2 is a block diagram of a major functional configuration of the inkjet recording device.

As illustrated in FIG. 1, the inkjet recording device 1 includes, for example, a medium feeder 10, a sheet heater 20, a medium conveyor 30, head units 40 (image generators), and a hardware processor 51 (see FIG. 2).

The sheet heater 20 in cooperation with the hardware processor 51 serves as a heating device.

In the inkjet recording device 1, a recording medium R is supplied from the medium feeder 10 to the sheet heater 20 and is then heated in the sheet heater 20 to a predetermined temperature. The head unit 40 discharges ink droplets on the recording medium R transferred by the medium conveyor 30 such that an image is generated or recorded on the recording medium R. The recording medium R with the generated image is transferred to a sheet ejector (not shown).

Examples of the recording medium R include various materials, such as paper, plastic, metal, cloth, and rubber.

The paper may be of various types, such as plain paper, board paper, corrugated board, coated paper, e.g., resin coated paper, and synthetic paper.

Ink droplets discharged on the recording medium R have different wetness levels depending on temperatures, which may cause inks to spread into the recording medium R. In the present invention, the recording medium R is preheated to a predetermined temperature. The uneven thicknesses of ink films caused by a variation in viscosity of the inks on the recording medium R is thereby reduced, resulting in color stability.

The medium feeder 10 includes, for example, a medium store 11, a feeding roller 12, and an initial medium temperature sensor 13.

The medium store 11 is a box that can accommodate one or more recording media R and moves upwardly or downwardly depending on the volume of the accommodated recording media R.

The feeding roller 12 transfers the top one of the recording media R in the medium store 11 to the sheet heater 20.

The initial temperature sensor 13 is disposed, for example, above the medium store 11 and detects the temperature of the top one of the recording media R in the medium store 11.

The sheet heater 20 receives the recording medium R from the medium feeder 10 and heats the recording medium R to a predetermined temperature while holding and transferring the recording medium R. After being heated to the predetermined temperature, the recording medium R is transferred to the medium conveyor 30. The configuration of the sheet heater 20 will be detailed below.

The medium conveyor 30 is a mechanism that is disposed under the head unit 40 and transfers the recording medium R from the sheet heater 20 at a predetermined rate.

The medium conveyor 30 includes, for example, a driving roller 31, a driven roller 32, a tension roller 33, and a conveyor belt 34.

The driving roller 31 is rotated around a rotary shaft 31*a* by the drive of a conveyor motor (not shown). The rotary shaft 31*a* in the driving roller 31 includes an encoder (a rotary encoder). The encoder can measure the circulation distance of the conveyor belt 34.

The driven roller 32 is spaced by a predetermined distance apart from the driving roller 31 and is rotated around a rotary shaft 32*a* by circulation of the conveyor belt 34. The rotary shaft 32*a* is disposed in parallel to the rotary shaft 31*a* in the driving roller 31.

The conveyor belt 34 is held and tightened by the tension roller 33, the driving roller 31, and the driven roller 32 inside the conveyor belt 34.

The conveyor belt 34 is an endless belt extending from the driving roller 31 to the driven roller 32 via the tension roller 33 and circulates in cooperation with the rotation of the driving roller 31 at a predetermined rate.

The conveyor belt 34 may be composed of a material that can flexibly deform at the contacts with the driving roller 31 and the driven roller 32 and certainly hold the recording medium R, such as a resin belt, rubber belt or steel belt. The conveyor belt 34 preferably has a property or structure capable of attracting the recording medium R. Such a conveyor belt 34 can more certainly receive the recording medium R.

The medium conveyor 30 receives the recording medium R on the transfer face of the conveyor belt 34. The conveyor belt 34 then circulates at a rate corresponding to the rotation rate of the driving roller 31. The recording medium R is thereby transferred in the direction of the circulating conveyor belt 34 under the head unit 40.

The recording medium R may be intermittently transferred, for example, in a manner that the transfer of the recording medium R is suspended while the head unit 40 is discharging ink droplets. In other words, the transfer of the recording medium R by the medium conveyor 30 involves suspension of the transfer of the recording medium R as described above.

The head unit 40 is a mechanism that causes the nozzles to discharge ink droplets onto one face (image generation face) of the recording medium R transferred by the medium conveyor 30 based on image data and generates an image on the recording medium R.

Four head units 40 for respective four inks yellow (Y), magenta (M), cyan (C), and black (K) are disposed in the sequence of Y, M, C, and K at predetermined intervals upstream of the transfer direction of the recording medium R.

It should be noted that any other number of head units 40 may be disposed and ink droplets of any other color may be discharged from the head units 40.

The head units 40 each includes recording heads 41 (see FIG. 2) including recording elements that are disposed along the width of the recording medium R (hereinafter referred to as "width") and orthogonal to the direction of the transferred recording medium R and a head controller 42 (see FIG. 2) that controls the discharge of ink droplets by the recording heads 41.

The recording heads 41 each have an ink discharge face with the holes on the nozzles. The ink discharge face confronts the transfer face of the conveyor belt 34.

The recording elements on the recording heads 41 each include a pressure chamber for storage of inks, a piezoelectric element on the wall of the pressure chamber, and a nozzle for discharge of ink droplets. A drive signal is applied to the piezoelectric element from a drive circuit of the recording head 41. In response to the drive signal, the piezoelectric element is deformed, which varies the pressure in the pressure chamber and causes the nozzles in communication with the pressure chamber to discharge ink droplets (ink drop discharge operation).

The recording elements of the head unit 40 are disposed along the width and covers the lateral area for image generation on the recording medium R transferred by the medium conveyor 30. The position of the head unit 40 is fixed against the medium conveyor 30 during the image generation. In other words, the inkjet recording device 1 generates the image according to a single-path scheme.

In the present invention, the inkjet recording device 1 may generate the image according to a scanning scheme where the recording medium R is transferred by the medium conveyor 30 and the recording head 41 discharging ink droplets scans the recording medium R along the width for generation of the image on the recording medium R.

The head controller 42 transmits various control signals and image data to the head driver of the recording head 41 at an appropriate time corresponding to the count of control signals from the hardware processor 51 or pulsed signals from the encoder in the driving roller 31.

In response to control signals and image data from the head controller 42, the head driver of the recording head 41 supplies drive signals to the recording elements on the recording head 41 to cause the piezoelectric elements to be deformed and cause the nozzles to discharge ink droplets from the holes.

FIG. 2 is a schematic block diagram of the control system of the inkjet recording device 1.

As illustrated in FIG. 2, the hardware processor 51 includes, for example, a memory 52, a communicator 53, an operation display 54, an ambient temperature sensor 55, a medium feeder 10, a sheet heater 20, a medium conveyor 30, and a head unit 40.

The hardware processor 51 includes, for example, a central processing unit (CPU) and a random access memory (RAM). The CPU of the hardware processor 51 reads system programs and various processing programs in the memory 52 to load the programs into the RAM and comprehensively controls the operations of the components of the inkjet recording device 1 according to the loaded programs.

For example, in response to an instruction for an image generation job from an external device or the operation display 54, the hardware processor 51 executes the job and instructs the medium conveyor 30 to transfer the recording medium R and instructs the head unit 40 to generate an image on the recording medium R based on the image data.

The hardware processor 51 instructs the sheet heater 20 to heat the recording medium R to a predetermined temperature before the image generation on the recording medium R.

The memory 52 includes, for example, a non-volatile semiconductor memory and a hard disk drive (HDD) to store programs executed by the hardware processor 51 and parameters and data required by the components of the inkjet recording device 1. For example, the memory 52 stores a pressure setting table T1, a heat-level setting table T2, a mode table T3 for setting the mode of the heating belt, which will be described below.

The communicator 53 transmits and receives data, such as image generation job and image data, to/from an external device (not shown) and includes, for example, any one of the serial interfaces and parallel interfaces or a combination of a serial interface and a parallel interface.

The operation display 54 includes a screen, such as liquid crystal display or organic electroluminescent display, and an input device, such as operation key or touch panel on the screen. The operation display 54 displays various information on the screen and converts a user input operation on the input device into operation signals to transmit the signals to the hardware processor 51.

The user can select conditions of image generation, such as the type of the recording medium R, density, and scale factor, on the operation display 54. The user can enter an instruction for an image generation job or an instruction for an operation in each mode on the operation display 54.

The ambient temperature sensor 55 detects the ambient temperature of the inkjet recording device 1 and transmits the detected results to the hardware processor 51.

The configuration of the sheet heater 20 will now be described in detail.

As described above, the sheet heater 20 is the mechanism that heats the recording medium R to a predetermined temperature before discharge of ink droplets from the head unit 40.

Referring back to FIG. 1, the sheet heater 20 includes a lower holder 20A, an upper holder 20B, and a temperature sensor or a medium temperature detector 20C.

The lower holder 20A includes, for example, a driving roller 21, a driven roller 22, and a holding conveyor belt 23.

The driving roller 21 is rotated around the rotary shaft 21*a* by the drive of a conveyor motor (not shown).

The driven roller 22 is spaced by a predetermined distance apart from the driving roller 21 and is rotated around a rotary shaft 22*a* by circulation of the holding conveyor belt 23. The rotary shaft 22*a* is disposed in parallel to the rotary shaft 21*a* in the driving roller 21.

The holding conveyor belt 23 is an endless belt extending from the driving roller 21 to the driven roller 22 and circulates in cooperation with the rotation of the driving roller 21 at a predetermined rate. The holding conveyor belt 23 may be composed of the same material as that of the conveyor belt 34 of the medium conveyor 30.

The holding conveyor belt 23 confronts a heating belt 27 (to be described below) of the upper holder 20B. The recording medium R is held and transferred between the holding conveyor belt 23 and the heating belt 27.

The upper holder 20B includes, for example, a first roller or pressing roller 24, a second roller or pressing roller 25, a heating roller 26, a heating belt 27, and a roller temperature sensor 28.

The first roller 24 is a driving roller rotatable around a rotary shaft 24*a* by the drive of a conveyor motor (not shown).

The second roller 25 is a driven roller that is spaced by a predetermined distance apart from the first roller 24 downstream of the first roller 24 in the transfer direction and is rotatable around a rotary shaft 25*a* by circulation of the heating belt 27. The rotary shaft is disposed in parallel to the rotary shaft 24*a* of the first roller 24.

The first roller 24 and the second roller 25, which are flush with each other, confront the holding conveyor belt 23 of the lower holder 20A and are urged to the recording medium R with intermediation of the heating belt 27.

The heating roller 26 is provided with, for example, a heat source H, such as halogen heater, which is disposed in a rotatable heat-conductive aluminum sleeve.

The heating roller 26 is disposed above the first roller 24 and the second roller 25 and is rotatable by circulation of the heating belt 27.

The heating belt 27 is in partial contact with the image generating face of the recording medium R.

The heating belt 27 is an endless belt extending from the first roller 24 via the second roller 25 to the heating roller 26 and circulates in cooperation with the rotation of the first roller 24 at a predetermined rate. During the circulation, the heating belt 27 is heated by the heating roller 26.

The heating belt 27 may be composed of the same material as that of the conveyor belt 34 of the medium conveyor 30.

The heating belt 27 confronts the holding conveyor belt 23 of the lower holder 20A and these belts thereby define a contact region 101 that holds and transfers the recording medium R.

The roller temperature sensor 28 is disposed near the heating roller 26 and detects the temperature of the heating roller 26.

In the sheet heater 20 having such a configuration, the holding conveyor belt 23 of the lower holder 20A holds the recording medium R together with the heating belt 27 of the upper holder 20B. The circulation of the holding conveyor belt 23 and the heating belt 27 at a predetermined rate causes the recording medium R to be transferred in the travelling direction of the holding conveyor belt 23 and the heating belt 27.

The heating belt 27 of the upper holder 20B heats the recording medium R during the transport of the recording medium R.

Figure 3A:
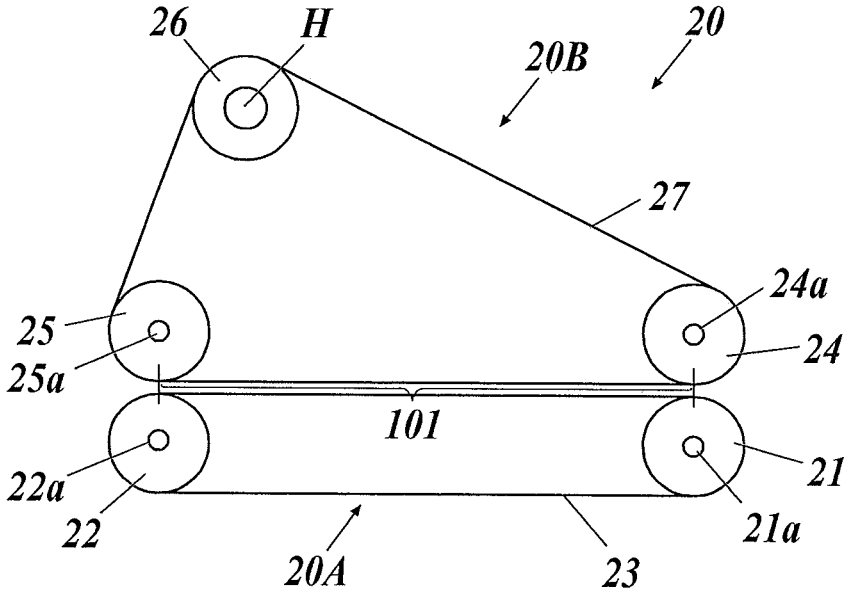
FIG. 3A illustrates a sheet heater.
Figure 3B:
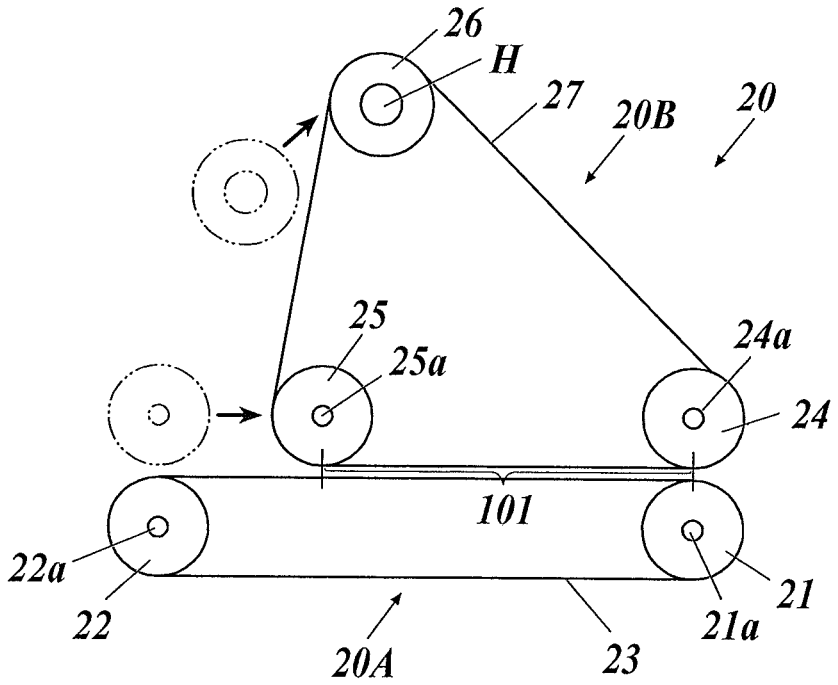
FIG. 3B illustrates the sheet heater.

As illustrated in FIGS. 3A and 3B, the upper holder 20B can shift the positions of the second roller 25 and the heating roller 26 relative to the first roller 24.

Specifically, the second roller 25 is provided with a first moving mechanism 25*b* (see FIG. 2) causing the rotary shaft 25*a* to proceed to or recede from the first roller 24 on the plain or the image generation face of the recording medium R while the rotary shaft 25*a* remains in parallel to the rotary shaft 24*a*. The hardware processor 51 controls the drive of the first moving mechanism 25*b* such that the distance between the second roller 25 and the first roller 24 is modified.

The heating roller 26 is provided with a second moving mechanism 26*b* (see FIG. 2) causing the rotary shaft to vary its position. The hardware processor 51 controls the second moving mechanism 26*b* such that the second moving mechanism 26*b* is driven in response to the movement of the second roller 25 and causes the heating roller 26 to shift to the position that keeps the tension of the heating belt 27 constant. In other words, the heating roller 26 serves as a tension adjustment roller that keeps the tension of the heating belt 27 constant.

The upper holder 20B having such a configuration modifies the area of the contact region 101 where the recording medium R is in contact with the heating belt 27.

In the present embodiment, the upper holder 20B is configured to select any of a first mode in FIG. 3A and a second mode in FIG. 3B.

In the first mode illustrated in FIG. 3A, the contact region 101 for the recording medium R to be in contact with the heating belt 27 has a relatively wide area. In other words, the first mode applies relatively high heat to the recording medium R.

In the second mode illustrated in FIG. 3B, the contact region 101 for the recording medium R to be in contact with the heating belt 27 has a relatively small area. In other words, the second mode applies relatively low heat to the recording medium R.

In this manner, the switching of the mode of the upper holder 20B, in other words, the variation of the area or the length of the contact region 101 for the recording medium R to be in contact with the heating belt 27 in the transfer direction allows ready temperature adjustment while the recording medium R is being heated.

The upper holder 20B is movable upwardly or downwardly relative to the lower holder 20A. In other words, the upper holder 20B can modify the gap between the heating belt 27 extending from the first roller 24 to the second roller 25 and the holding conveyor belt 23 extending from the driving roller 21 to the driven roller 22.

The nip pressure between the holding conveyor belt 23 of the lower holder 20A and the heating belt 27 of the upper holder 20B can be thereby set and modified while the recording medium R is held in the nip.

It should be noted that only the lower holder 20A may be movable upwardly or downwardly relative to the upper holder 20B or both the upper holder 20B and the lower holder 20A may be movable upwardly or downwardly.

The medium temperature sensor 20C is disposed downstream of a nip of the holding conveyor belt 23 and the heating belt 27 in the transfer direction. The medium temperature sensor 20C detects the temperature of the image generation face of the recording medium R that has passed through the nip, in other words, that has been heated.

The tables stored in the memory 52 will now be described.

FIG. 4 depicts exemplary items on the pressure setting table T1. FIG. 5 depicts exemplary items on the heat-level setting table T2. FIG. 6 depicts an exemplary items on the mode table T3 for setting the mode of the heating belt.

The pressure setting table T1 presets the pressure applied to the recording medium R while the sheet heater 20 holds and transfers the recording medium R. As illustrated in FIG. 4, the pressure setting table T1 includes items, for example, type T11, belt pressure level T12, preset gap T13, and allowable range T14.

The type T11 defines the type of the recording medium R. The belt pressure level T12 presets the value representing the nip pressure. The preset gap T13 presets the value representing the gap between the belts of the sheet heater 20 according to the belt pressure level. The allowable range T14 is determined to the preset gap between the belts of the sheet heater 20.

The heat-level setting table T2 presets the temperature for heating of the recording medium R by the sheet heater 20. As illustrated in FIG. 5, the heat-level setting table T2 includes items, such as type T21, ambient temperature T22, initial temperature T23, and heat level T24.

The type T21 defines the type of the recording medium R. The ambient temperature T22 represents the temperature in the environment of the inkjet recording device 1. The initial temperature T23 represents the temperature before the image generation on the recording medium R. The heat level T24 presets the value representing the heat level.

The mode table T3 for setting the mode of the heating belt sets the mode of the heating belt during heating of the recording medium R by the sheet heater 20. As illustrated in FIG. 6, the mode table T3 for setting the mode of the heating belt includes items, such as heat level T31, mode T32 of heating belt, and initial target temperature T33.

The heat level T31 presets the value representing the heat level. The mode T32 of the heating belt indicates the mode of the sheet heater 20 during heating of the recording medium R by the heating belt. A first mode or a second mode is selected depending on the value of the heat level. The initial target temperature T33 represents the initial target temperature of the heating belt and is preset to the heat level.

Operation of Inkjet Recording Device

The operation of the inkjet recording device 1 will now be explained.

The inkjet recording device 1 according to the present embodiment causes the sheet heater 20 to heat the recording medium R before discharge of ink droplets onto the recording medium R (referred to as "pre-heating process").

During the execution of the job (referred to as "image generation process") for continuous generation of images on, for example, one-thousand recording media R, the mode of the sheet heater 20 is adjusted such that the recording media R can be heated to an appropriate temperature.

Figure 7:
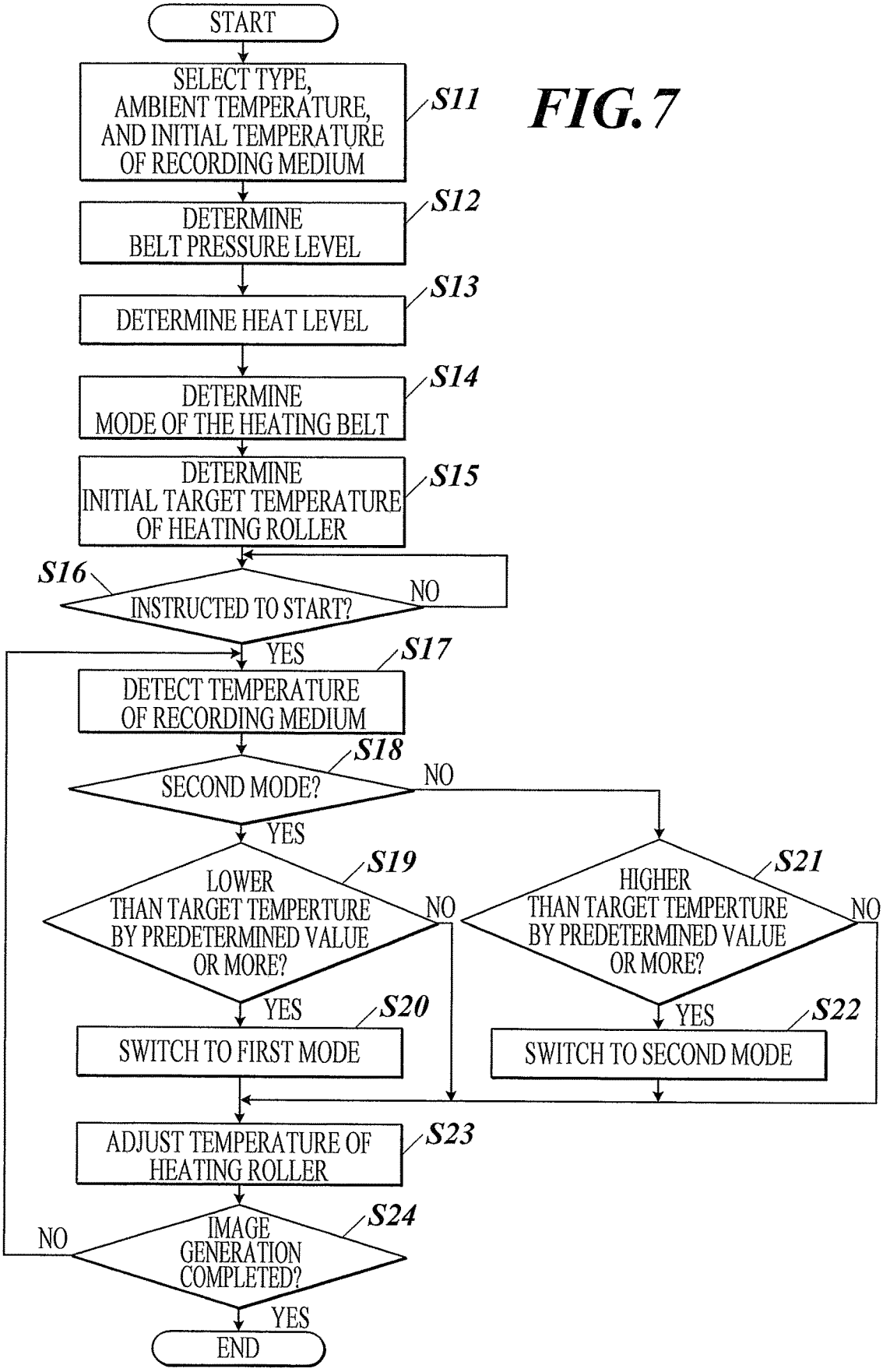
FIG. 7 is a flowchart on operations of the inkjet recording device.

FIG. 7 is a flowchart illustrating the pre-heating process (Steps S11 to S15) and the image generation process (Steps S16 to S24) in the inkjet recording device 1.

The hardware processor 51 receives the data of the type of the recording medium R, the ambient temperature, and the initial temperature of the recording medium R (Step S11).

The type of the recording medium R is determined by preselection of the recording medium R by a user on the operation display 54 before the image generation process.

The ambient temperature represents the temperature in the environment of the inkjet recording device 1. The ambient temperature is acquired based on the results detected by the ambient temperature sensor 55.

The initial temperature of the recording medium R refers to the temperature of the top one of the recording media R in the medium store 11. The initial temperature is acquired based on the results detected by the initial medium temperature sensor 13 above the medium feeder 10.

The hardware processor 51 determines the belt pressure level according to the type of the recording medium R received in Step S11 with reference to the pressure setting table T1 (Step S12).

The belt pressure level sets the gap between the belts of the sheet heater 20.

For example, the belt pressure level "5" is preset for the selected recording medium R, i.e., the corrugated board C. The gap between the two belts of the sheet heater 20 is set to "5.0 mm".

The hardware processor 51 determines the heat level according to the type of the recording medium R, the ambient temperature, and the initial temperature of the recording medium R received in Step S11 with reference to the heat-level setting table T2 (Step S13).

For example, the heat level is set to "5" in a case where the corrugated board C is a selected recording medium R and where the ambient temperature and the initial temperature of the recording medium R are 25° C.

In reference to the mode table T3 for setting the mode of the heating belt, the hardware processor 51 selects the mode of the heating belt according to the heat level determined in Step S13 (Step S14).

Thus, the sheet heater 20, i.e., the upper holder 20B is in the selected mode of the heating belt.

For example, the heating belt is in the first mode or high-heat mode at a heat level of "5" (see FIG. 3A).

The hardware processor 51 determines the initial target temperature of the heating roller 26 according to the heat level determined in Step S13 with reference to the mode table T3 for setting the mode of the heating belt (Step S15).

Thus, the heating roller 26 is heated to the set initial target temperature.

For example, the initial target temperature is set to "40° C." at a heat level of "5".

After the pre-heating process, the sheet heater 20 is ready to receive the recording medium R. The sheet heater holds this state until the instruction for start of the image generation process.

The hardware processor 51 checks for the instruction for start of the image generation process (Step S16). If the start is not instructed (Step S16: No), the hardware processor 51 repeats the operation in Step S16.

If the instruction is received (Step S16: Yes), the hardware processor 51 instructs the medium feeder 10 to start the transportation of the recording medium R. In following description, the instruction relates to the execution of continuous image generation on recording media R of the same type.

After the recording medium R passes through the nip of the holding conveyor belt 23 and the heating belt 27 and arrives at the medium temperature sensor 20C, the hardware processor 51 instructs the medium temperature sensor 20C to detect the temperature of the image generation face of the recording medium R (Step S17).

The hardware processor 51 then determines whether the sheet heater 20, i.e., the upper holder 20B is in the second mode (Step S18).

If the upper holder 20B is in the second mode (Step S18: Yes), the hardware processor 51 determines whether the detected temperature of the recording medium R in Step S17 is lower than the initial target temperature determined in Step S15 by a predetermined value or more, for example, 5° C. or more (Step S19). If the detected temperature is lower than the initial target temperature (Step S19: Yes), the hardware processor 51 switches the mode of the upper holder 20B to the first mode (Step S20) and the process goes to Step S23, which will be described below.

If the detected temperature is not lower than the initial target temperature (Step S19: No), the process of the hardware processor 51 goes to Step S23.

If the upper holder 20B is not in the second mode (Step S18: No), the hardware processor 51 determines whether the detected temperature of the recording medium R in Step S17 is higher than the initial target temperature determined in Step S15 by a predetermined value or more, for example, 5° C. or more (Step S21). If the detected temperature is higher than the initial target temperature (Step S21: Yes), the hardware processor 51 switches the mode of the upper holder 20B to the second mode (Step S22) and the process goes to Step S23.

If the detected temperature is not higher than the initial target temperature (Step S21: No), the process of the hardware processor 51 goes to Step S23.

The hardware processor 51 adjusts the temperature of the heating roller 26 (Step S23).

The hardware processor 51 determines whether all the images have been generated (Step S24). If all the images have not been generated (Step S24: No), the process returns to Step S17 and the subsequent steps are repeated.

In the case that all the images have been generated (Step S24: Yes), the hardware processor 51 terminates the process.

In the image generation process, the mode of the sheet heater 20 can be switched according to the detected temperature of the recording medium R and the recording medium R can be heated to an appropriate temperature.

Advantageous Effect of Embodiment

As described above, the sheet heater 20 according to the present embodiment is in partial contact with an image generation face of a recording medium R and includes multiple rollers; a heating belt 27 extending over the rollers and being capable of circulating in cooperation with the rollers; and a heating roller 26 that heats the heating belt 27. First and second rollers 24 and 25 among the rollers are urged to the recording medium R with intermediation of the heating belt 27. A hardware processor 51 modifies the distance between the first roller 24 and the second roller 25 such that the area of the heating belt 27 heated by the heating roller 26 is modified. The heating belt 27 is in contact with the recording medium R.

The modification of the area of the heating belt 27 in contact with the recording medium R allows the control of the heat applied to the recording medium R. Thus, the recording medium R can be heated to a predetermined temperature regardless of the type of the recording medium R.

In accordance with this embodiment, the first and second rollers 24 and 25 are disposed in the travelling direction of the heating belt 27 and urged to the recording medium R with intermediation of the heating belt 27. The second roller 25 includes a first moving mechanism 25*b* for procession to or recession from the first roller 24 over the image generation face of the recording medium R. The hardware processor 51 instructs the first moving mechanism 25*b* to drive the second roller 25 to proceed to or recede from the first roller 24 such that the distance between the first roller 24 and the second roller 25 is modified.

The modification of the distance between the first roller 24 and the second roller 25 can modify the area of the heating belt 27 in contact with the recording medium R.

In accordance with this embodiment, the sheet heater 20 further includes a medium temperature sensor 20C that detect the temperature of the recording medium R after contact of the recording medium R with the heating belt 27 heated by the heating roller 26. The hardware processor 51 enlarges the distance between the first roller 24 and the second roller 25 if the temperature, detected by the medium temperature sensor 20C, of the recording medium R is lower than a predetermined target value.

The hardware processor 51 reduces the distance between the two rollers if the temperature, detected by the medium temperature sensor 20C, of the recording medium R is higher than a predetermined target value.

The distance between the first roller 24 and the second roller 25 can be modified based on the detected temperature of the heated recording medium R.

In accordance with this embodiment, the sheet heater 20 further includes a holding conveyor belt 23 confronting the heating belt 27. The holding conveyor belt 23 and the heating belt 27 form a nip that holds and transports the recording medium R. The hardware processor 51 sets the nip pressure at the nip according to the type of the recording medium R.

Specifically, the holding conveyor belt 23 extends over the rollers and can circulate in cooperation with the rollers. The hardware processor 51 set the nip pressure at the nip by controlling the gap defined by the first and second rollers 24 and 25 over which the heating belt 27 is extended and the rollers over which the holding conveyor belt 23 is extended.

The nip pressure is set depending on the type of the recording medium R. Thus, various types of recording media R can be heated.

For example, the recording medium R composed of a corrugated board can be efficiently heated to a predetermined temperature without the risk of crush.

In accordance with this embodiment, the hardware processor 51 keeps the nip pressure at the nip constant during continuous transportation of the recording media R of the same type.

Thus, the efficiency in the continuous heating of the recording media R of the same type can be enhanced.

In this embodiment, the second roller 25 of the upper holder 20B proceeds to or recedes from the first roller 24. Alternatively, the first roller 24 may move relative to the second roller 25 or both the first roller 24 and the second roller 25 may move relative to each other.

In this embodiment, the heating roller 26 heats the heating belt 27. Alternatively, any other component may be used to heat the heating belt 27. For example, an additional heater may be disposed external to the heating belt 27 to partially heat the circulating heating belt 27.

In this embodiment, the upper holder 20B is switched between the first mode and the second mode. Alternatively, the distance between the driving roller 21 and the driven roller 22 may be switched among three or more levels.

In this manner, the area of the contact face can be more finely tuned.

In this embodiment, the upper holder 20B includes two rollers, and one of the rollers moves for modification of the distance between the two rollers such that the area of the heating belt 27 in contact with the recording medium R is modified. Alternatively, the upper holder 20B have any other configuration that can modify the area of the heating belt 27 in contact with the recording medium R.

Figure 8A:
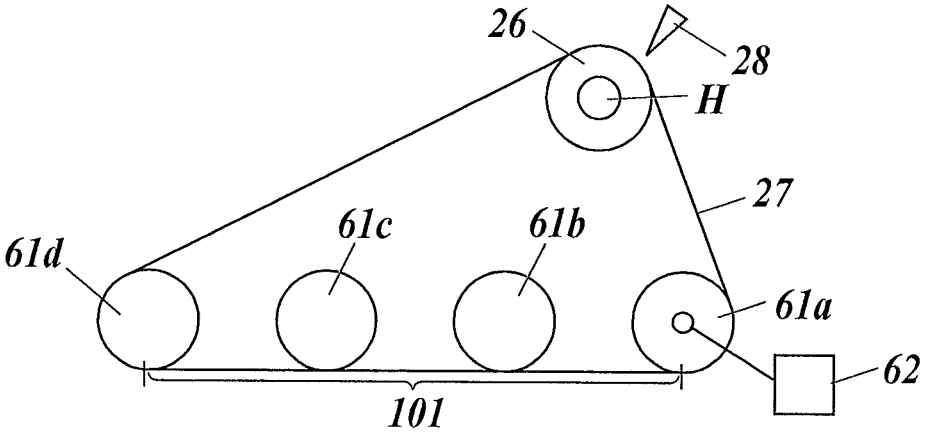
FIG. 8A illustrates another aspect of the sheet heater.

As illustrated in FIG. 8A, the upper holder 20B may include, for example, first to fourth rollers (pressing rollers) 61*a* to 61*d*, a heating roller 26, a heating belt 27, and a roller temperature sensor 28.

The first to fourth rollers 61*a* to 61*d* are disposed in the travelling direction of the heating belt 27 and urged to the recording medium R with intermediation of the heating belt 27.

The first to fourth rollers 61*a* to 61*d* each includes a moving mechanism 62 for recession from the image generation face of the recording medium R. In FIG. 8A, only the moving mechanism 62 of the first roller 61*a* is illustrated, while the moving mechanisms 62 of the second to fourth rollers 61*b* to 61*d* are not shown.

In such a configuration, one or more rollers including at least one of the most upstream roller and the most downstream roller other than two intermediate rollers among the first to fourth rollers 61*a* to 61*d* in the moving direction of the heating belt 27 recede from the image generation face of the recording medium R. The distance between the rollers most upstream and most downstream of the travelling direction of the heating belt 27 can be thereby modified.

Figure 8B:
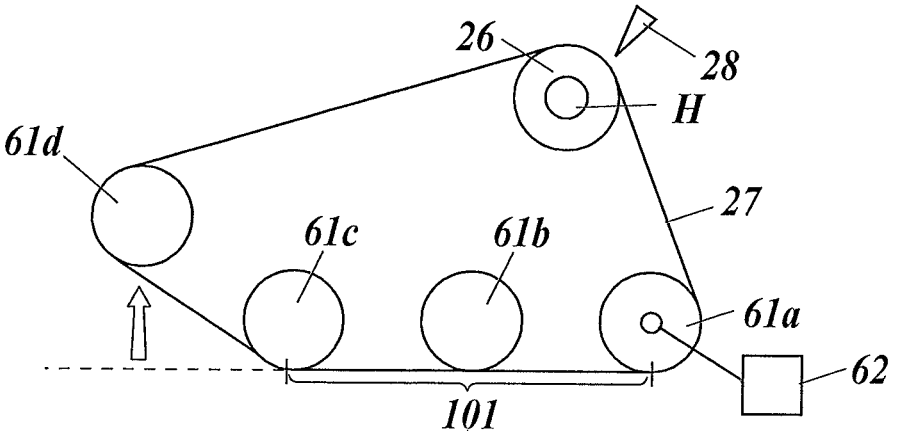
FIG. 8B illustrates another aspect of the sheet heater.

As illustrated in FIG. 8B, the fourth roller 61*d* most downstream of the travelling direction of the heating belt 27 recedes from the image generation face of the recording medium R. The most upstream roller is the first roller 61*a* and the most downstream roller is the third roller 61*c* among the rollers urged to the recording medium R with intermediation of the heating belt 27, resulting in a reduced distance between the first roller 61*a* and the third roller 61*c*.

Figure 8C:
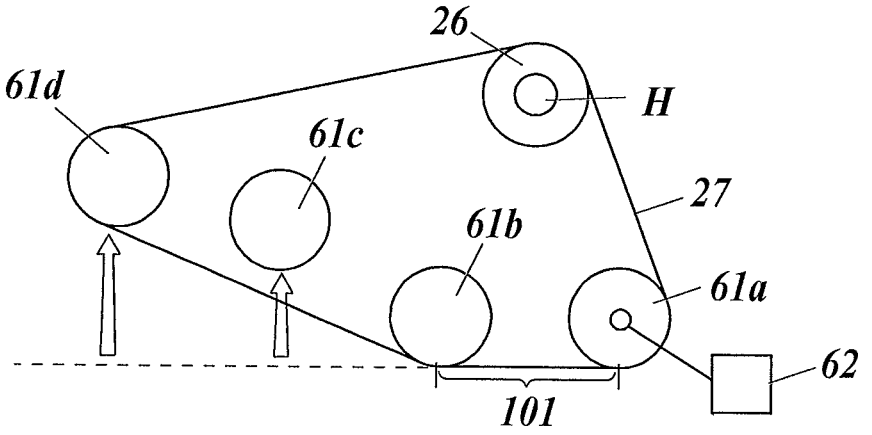
FIG. 8C illustrates still another aspect of the sheet heater.

As illustrated in FIG. 8C, the most downstream fourth roller 61*d* and the neighboring third roller 61*c* recede from the image generation face of the recording medium R in the travelling direction of the heating belt 27. The most upstream is the first roller 61*a* and the most downstream roller is the second roller 61*b* among the rollers urged to the recording medium R with intermediation of the heating belt 27, resulting in a more reduced distance.

This configuration can vary the number of rollers receding from the image generation face of the recording medium R, resulting in the finer tuning of the area of the contact face.

It should be noted that the roller(s) including the first roller 61*a* most upstream of the travelling direction of the heating belt 27 may recede from the image generation face of the recording medium R.

The detailed configuration of the image generator and the detailed operation of the components may be varied without departing from the spirit of the present invention.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese patent application No. 2018-018800, filed on Feb. 6, 2018, is incorporated herein by reference in its entirety.

What is claimed is:

1. A heating device comprising:

a first group of rollers;

a heating belt in partial contact with an image generation face of a recording medium, the heating belt extending over the first group and circulating in cooperation with the first group;

a heater that heats the heating belt; and a hardware processor that modifies an area of contact between the recording medium and the heating belt, wherein at least two rollers in the first group are disposed along a traveling direction of the heating belt and are urged to the recording medium with intermediation of the heating belt, and the hardware processor modifies the area of the contact by modifying a distance between a first roller and a second roller among the at least two rollers, the first and second rollers being respectively disposed most upstream and most downstream in the travelling direction of the heating belt.

2. The heating device according to claim 1, wherein the at least two rollers consist of the first and second rollers, at least one of the first and second rollers comprises a moving mechanism for procession to or recession from another roller over the image generation face of the recording medium, and the hardware processor modifies the distance between the first and second rollers by instructing the moving mechanism to drive the at least one of the first and second rollers to proceed to or recede from another roller.

3. The heating device according to claim 1, wherein the at least two rollers consist of three or more rollers including the first and second rollers, each of the three or more rollers comprises a moving mechanism for recession from the image generation face of the recording medium, and the hardware processor modifies the distance between the first and second rollers by instructing the moving mechanism to drive at least one of the first and second rollers to recede from the image generation face of the recording medium.

4. The heating device according to claim 1, further comprising:

a temperature detector that detects the temperature of the recording medium after contact of the recording medium with the heating belt heated by the heater, wherein the hardware processor enlarges the distance between the first and second rollers if the temperature of the recording medium detected by the temperature detector is lower than a predetermined target value.

5. The heating device according to claim 1, further comprising:

a temperature detector that detects the temperature of the recording medium after contact of the recording medium with the heating belt heated by the heater, wherein the hardware processor reduces the distance between the first and second rollers if the temperature detected by the temperature detector is higher than a predetermined value.

6. The heating device according to claim 1, further comprising:

a holding conveyor belt confronting the heating belt, the holding conveyor belt and the heating belt forming a nip that holds and transports the recording medium, wherein the hardware processor sets a nip pressure at the nip depending on the type of the recording medium.

7. The heating device according to claim 6, wherein the hardware processor keeps the nip pressure at the nip constant during continuous transportation of recording media of a same type.

8. The heating device according to claim 6, further comprising:

a second group of rollers, wherein the holding conveyor belt extends over the second group and circulates in cooperation with the second group, and the hardware processor sets the nip pressure at the nip by modifying a gap between the second group and the at least two rollers in the first group.

9. An inkjet recording device comprising:

the heating device according to claim 1; and an image generator that discharges ink droplets onto the recording medium heated by the heating device to generate an image.

* * * * *